US005383626A

United States Patent [19]

Häfner

[11] Patent Number: 5,383,626

[45] Date of Patent: Jan. 24, 1995

[54] TAKE-UP REEL FOR ROLLABLE WINDING MATERIAL

[75] Inventor: Manfred Häfner, Leopoldshöhe, Germany

[73] Assignee: Häfner & Krullmann GmbH, Germany

[21] Appl. No.: 973,718

[22] Filed: Nov. 9, 1992

[30] Foreign Application Priority Data

Nov. 12, 1991 [DE] Germany ..... 9114007[U]

[51] Int. Cl.[6] ..... B65H 75/14

[52] U.S. Cl. ..... 242/614.1

[58] Field of Search ..... 242/117, 116, 115, 77.3, 242/71.8, 71.9, 118.6, 118.61, 614.1

[56] References Cited

U.S. PATENT DOCUMENTS

| | | | |
|---|---|---|---|
| 230,665 | 8/1880 | Schmieding | 242/115 |
| 877,398 | 1/1908 | Brinley | 242/117 |
| 901,719 | 10/1908 | Mason | 242/117 |
| 2,574,845 | 11/1951 | Schaefer | 242/77.3 |
| 2,626,764 | 1/1953 | Dunlap | 242/118.61 |
| 2,928,619 | 3/1960 | Burton et al. | 242/118.61 X |
| 3,276,717 | 10/1966 | Lewis et al. | 242/118.61 |
| 3,421,191 | 1/1969 | Hanna | 242/71.8 |

*Primary Examiner*—John M. Jillions
*Attorney, Agent, or Firm*—Henry M. Feiereisen

[57] ABSTRACT

A take-up reel for rollable winding material includes a barrel provided with opposing end flanges, with each end flange having a barrel-distant outer surface which includes knobs to define profile-forming bumps. The knobs are arranged about a circle which extends concentric to the barrel and has a diameter which is greater than the diameter of the barrel. The outer surface of each knob extends in a plane parallel to the inner surface of the end flanges.

10 Claims, 1 Drawing Sheet

TAKE-UP REEL FOR ROLLABLE WINDING MATERIAL

BACKGROUND OF THE INVENTION

The present invention refers to a take-up reel for rolling and unrolling winding material such as strips, wires and the like, and in particular to a take-up reel of the type having a barrel with two disk-like end flanges which are provided at their outer end faces with profile-forming bumps.

In general, a take-up reel of this type is made of shock resistant plastic material and of H-shaped configuration in longitudinal section. The lateral end flanges retain the reeled winding material upon the barrel and serve as abutment for co-rotating support skirts of a winding machine.

Conventional reels of this type have bumps in form of radial ribs which are spaced from each other at a small angular distance. The ribs reinforce in particular the end flanges to lessen a flexure thereof. Moreover, these end flanges are suitably dimensioned to withstand centrifugal forces in particular during initial winding when these centrifugal forces are very high. The initial winding speed ranges up to for example 4,000 rpm.

Practice has shown that the use of such radial ribs subjects the end flanges to stress concentrations in the area of the juncture to the barrel when the take-up reel is dropped and impacts on the rim of one end flange e.g. during a stress test or during inadvertent fall, resulting in fine tearings which are not visible to the naked eye. Therefore, for safety reasons, a reuse of take-up reels of this type is not advised. Practice has also shown that at extremely high speeds parts of the end flanges are thrown off.

SUMMARY OF THE INVENTION

It is thus a general object of the present invention to provide an improved take-up reel of this type obviating the afore-stated drawbacks.

It is further an object of the present invention to provide an improved take-up reel which is characterized by a significantly higher shock resistance.

These objects and others which will become apparent hereinafter are attained in accordance with the present invention by providing the barrel-distant outer surface of each end flange with profile-forming bumps configured as projecting knobs which are spaced about a circle extending concentric to the barrel and defined by a diameter greater than the diameter of the barrel, and which have an outer surface extending in a plane parallel to the inner surface of the end flanges.

By providing the outer surface of the end flanges with such knobs, the total cross sectional area of these knobs is significantly smaller compared to the overall cross sectional area of ribs of conventional take-up reels. Extreme material accumulations are avoided so that forces generated during a fall of the take-up reel are evenly distributed. Therefore, a take-up reel according to the present invention not only can be wound and thus reused more frequently so that the number of disposed take-up reels is significantly reduced, but the arrangement of such knobs upon the outer surface of the end flanges results also in a material saving compared to conventional take-up reels.

Since the knobs bear upon the support skirts of the winding machine, and the support skirts have different diameters, it is preferred to arrange the knobs about several, preferably three circles which are concentric to the barrel. Suitably, neighboring knobs are spaced from each other about each circle at a same angular distance. In this manner, the knobs may not cause any unbalance. Since the knobs are spaced from each other at equal angular distance about the single circles, the radian measure between two knobs increases from the innermost circle towards the outermost circle. In order to facilitate ejection of the take-up reel when being produced by injection molding, the knobs are preferably of conical configuration, with their cross section narrowing towards the outer surface thereof.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
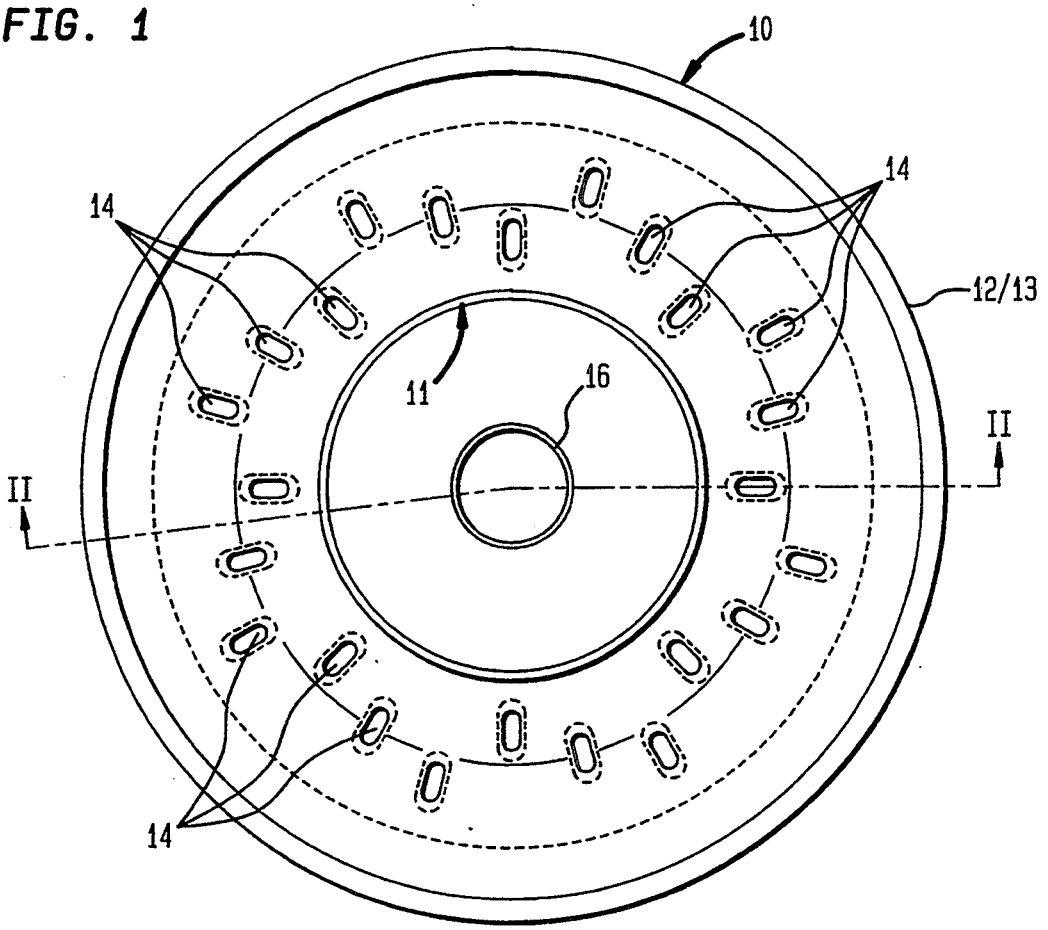
FIG. 1 is a plan view of a take-up reel according to the invention.

Throughout all the Figures, the same or corresponding elements are always indicated by the same reference numerals.

Referring now to the drawing, there is shown a take-up reel, generally designated by reference numeral 10 and including a cylindrical barrel 11 which is provided at its two opposing end faces with disk-shaped end flanges 12, 13. The end flanges 12, 13 have an inner surface 17 which extends perpendicular to the rotational axis R of the take-up reel 10 i.e. perpendicular to the circumference of the barrel 11, with the lower end flange 13 being provided with downwardly extending central heels 15, respectively arranged at each side of the barrel 11 and having an outer diameter which approximately corresponds to the outer diameter of the barrel 11.

The take-up reel 10 is further provided with a central bushing 16 which extends inside the barrel 11 over a portion of its length and serves for attachment to a winding machine. The bushing 16 is connected in one piece with the barrel 11 via a suitable connecting member 18 to form with the barrel 11 and with the end flanges 12, 13 a one-piece molding of plastic material.

Although not shown in the drawing, persons skilled in the art will understand that the barrel 11 may also be provided with a bushing in opposition to the bushing 16.

Figure 2:
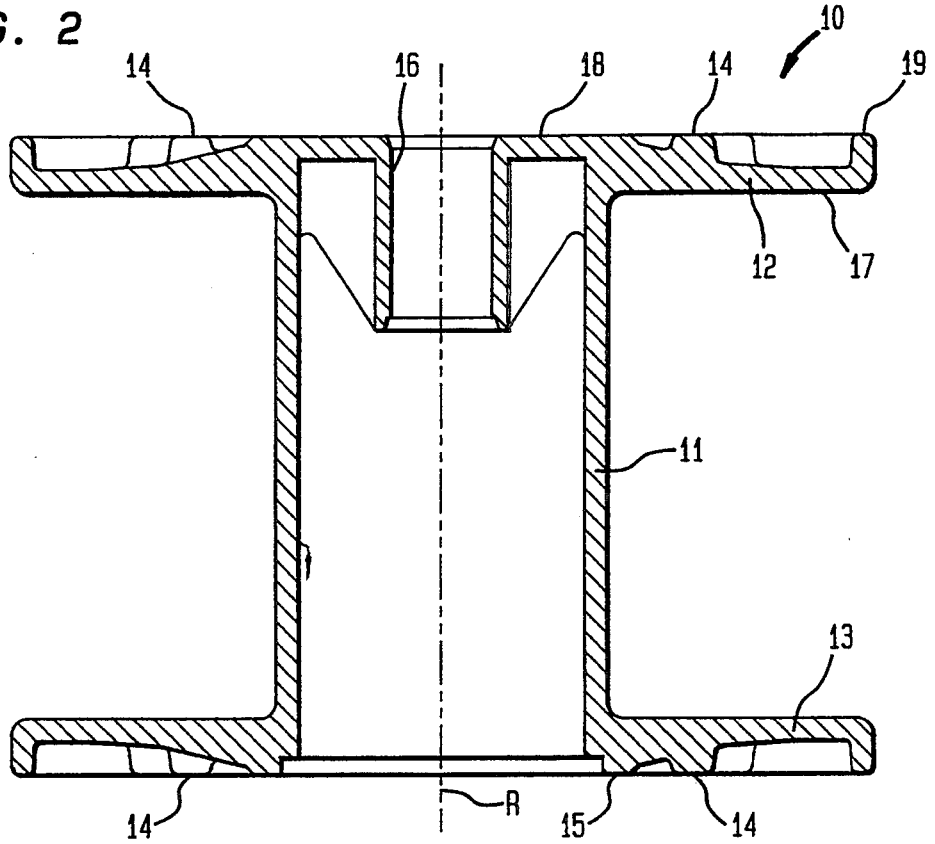
FIG. 2 is a longitudinal section of the take-up reel according to FIG. 1, taken along the line II—II in FIG. 1.

As shown in particular in FIG. 2, the end flanges 12, 13 are each provided with an outwardly hooked border 19. The free end of the border 19 of the lower end flange 13 extends flush with the outer surface of the heels 15 while the hook-shaped border 19 of the upper end flange 12 extends flush with the connecting member 18 of the bushing 16.

Each end flange 12, 13 has a wall thickness which narrows radially in direction to the border 19. Suitably, the wall thickness of each end flange 12, 13 continuously narrows in form of an arch or a curve or in form of bends with visible junctures in direction of the border 19.

As best seen in FIG. 1, the barrel-distant outer surface of each end flange 12, 13 is provided with a number of knobs 14 to define profile-forming bumps. In the nonlimiting example of the take-up reel 10 as shown in the drawing, the knobs 14 are arranged in three rows, with the knobs 14 of each row being spaced on a circle which extends concentric to the barrel 11, and with each row comprising eight knobs 14. The knobs 14 are spaced on the various circles at same angular distance to each other so that the radian measure between two knobs on the outermost circle is greater than the radian measure of the inner and central circles.

The drum-distant outer surface of the knobs 14 extends flush with the free ends of the border 19 of the end flanges 12, 13 and thus flush with the heels 15 of end flange 13 and the connecting member 18 of bushing 16. Suitably, the knobs 14 are of conical configuration, with the cross section narrowing towards its free outer surface.

As shown in FIG. 1, the knobs 14 are mounted to the end flanges 12, 13 in such a manner that successive knobs 14 are positioned on a different circle so that a staggered or offset relationship of successive knobs 14 is created. The diameters of the circles are selected in such a manner that successive knobs 14 overlap in a direction of rotation of the barrel 11.

While the invention has been illustrated and described as embodied in a take-up reel for rollable winding material, it is not intended to be limited to the details shown since various modifications and structural changes may be made without departing in any way from the spirit of the present invention.

What is claimed as new and desired to be protected by Letters Patent is set forth in the appended claims:

1. A take-up reel for rollable material, comprising a barrel defined by a diameter and having opposing end faces provided with an end flange forming a barrel-near inner surface and a barrel-distant outer surface, said barrel-distant outer surface being provided with knobs, each said knob being located on the flange at a diameter greater than the diameter of said barrel and each said knob having a center, wherein the center of successive knobs is arranged about different circles extending concentric to said barrel.

2. A take-up reel as defined in claim 1 wherein said knobs are arranged about three circles extending concentric to said barrel.

3. A take-up reel as defined in claim 1 wherein neighboring knobs are spaced from each other about a circle by a same angular distance.

4. A take-up reel as defined in claim 1 wherein each end flange has an outer border and a cross section narrowing toward the outer border thereof, with the barrel-distant outer surface of each end flange tapering in direction toward the barrel-near inner surface.

5. A take-up reel as defined in claim 4 wherein the barrel-distant outer surface of each end flange tapers in form of an arch.

6. A take-up reel as defined in claim 4 wherein the barrel-distant outer surface of each end flange tapers in form of a curve.

7. A take-up reel as defined in claim 4 wherein the barrel-distant outer surface of each end flange tapers in form of bends.

8. A take-up reel as defined in claim 1 wherein said knobs have an outer surface extending in a plane parallel to the barrel-near inner surface of said end flange.

9. A take-up reel as defined in claim 1 wherein said end flange is provided with a heel extending downwards in axial direction of said barrel and defining an outer surface, said knobs, having an outer surface extending flush with said outer surface of said heel.

10. A take-up reel as defined in claim 1 wherein each said knob is of conical configuration and having a cross section narrowing toward the outer surface thereof.

* * * * *